US005640857A

United States Patent [19]

Halik

[11] Patent Number: 5,640,857

[45] Date of Patent: Jun. 24, 1997

[54] DECORATIONS FOR WATCHBANDS AND BRACELETS

[76] Inventor: Joseph Halik, 1807 S. 56th Ct., Cicero, Ill. 60650

[21] Appl. No.: 435,865

[22] Filed: May 4, 1995

[51] Int. Cl.[6] ..... A44C 11/00

[52] U.S. Cl. ..... 63/21

[58] Field of Search ..... 63/21, 22, 23, 63/2; 24/163 K

[56] References Cited

U.S. PATENT DOCUMENTS

| | | | |
|---|---|---|---|
| 3,014,298 | 12/1961 | Kirshner | 63/21 |
| 4,280,254 | 7/1981 | Racke | 24/163 K |
| 4,353,124 | 10/1982 | Weinzettel et al. | 63/21 X |
| 5,097,997 | 3/1992 | Kipnis et al. | 24/163 K |

*Primary Examiner*—Kien T. Nguyen
*Attorney, Agent, or Firm*—Juettner Pyle Lloyd & Piontek

[57] ABSTRACT

A decoration for a bracelet or a watchband, such as an expansion watchband, is characterized by a decorative chip and a bracket for attaching the chip to the watchband. The bracket is generally U-shaped and has a bottom wall on which a bottom surface of the watchband rests, side walls extending from opposite sides of the bottom wall upwardly past opposite sides of the watchband to above an upper surface of the watchband, and flanges extending inwardly in facing relationship from upper ends of the side walls. The chip has a pair of opposite sides in parallel relationship and a channel extends in and along the length of each opposite side. The chip is slid onto the bracket with the facing side wall flanges being received in the channels in the sides of the chip and with the watchband being captured between the chip and the bracket. The bracket is made of a relatively rigid yet flexible material and its dimensions are such that the watchband is gripped between the bracket and the chip, so that the bracket attaches the decorative chip to the watchband.

11 Claims, 2 Drawing Sheets

DECORATIONS FOR WATCHBANDS AND BRACELETS

BACKGROUND OF THE INVENTION

The present invention relates to decorative items, and in particular to decorations for watchbands and bracelets.

Decorative items are commonly worn, often for fun, often because they satisfy a particular need of the wearer, or simply because they are attractive and present a pleasing appearance. A decorative item may be worn as jewelry, either alone or together with other pieces of jewelry. It may be worn for symbolic purposes, in which case it may be configured to represent the name of a person or some other facet or feature of life that is of importance to the wearer. A decorative item may also be configured as a good luck symbol or charm and worn with the thought in mind of bringing good fortune and good luck to the wearer.

Decorative items are normally worn by being pinned to clothing of the wearer or by attachment to a necklace or bracelet. However, such means for enabling decorative items to be worn are not suitable where the items are to be freely given away for advertising, novelty or other purposes. To have to provide a bracelet, necklace or pin, in addition to the decorative item itself, adds considerable cost to what might otherwise be a relatively inexpensive giveaway item.

Many people wear wristwatches having a watchband, or bracelets configured generally like a watchband. For decorative items that are given away for advertising, commemorative, novelty, goodwill and other such purposes, it would be desirable from a cost standpoint to provide a means for the item to be economically attached to a watchband or bracelet of a wearer. This would avoid the need for and expense of providing a separate bracelet, necklace or pin to enable the decorative item to be worn.

OBJECT OF THE INVENTION

The primary object of the present invention is to provide decorative items for watchbands and bracelets, which may conveniently, economically and removably be attached to a watchband or bracelet without need for modification of the watchband or bracelet.

SUMMARY OF THE INVENTION

In accordance with the present invention, there is provided a decorative item for watchbands, bracelets and the like. The decorative item includes a decorative chip having a decorative top surface, a bottom surface, side surfaces on opposite sides of the chip, and channel means in each side surface. The decorative item also includes a bracket for holding the decorative chip and for attaching the chip to a watchband or bracelet. The bracket has a bottom wall for extending across a lower surface of a watchband or bracelet, side wall means extending upwardly from opposite sides of the bottom wall and for extending past opposite sides of the watchband or bracelet to upper ends of the side wall means above an upper surface of the watchband or bracelet, and flange means at the upper end of each side wall means. The flange means are received in the channel means in the side surfaces of the chip to mount the chip on the bracket with the decorative top surface of the chip facing upward and away from the bottom wall of the bracket and for capturing the watchband or bracelet between the bracket bottom wall, the bracket side wall means and the chip bottom surface, whereby the decorative chip is attached by the bracket to the watchband or bracelet.

In one embodiment of the invention, each of the side wall means of the bracket is a mirror image of the other and comprises a side wall extending generally vertically upward from the bracket bottom wall to an upper end of the side wall, and each flange means comprises a flange extending generally horizontally from an upper end of the side wall of its side wall means and over the bottom wall toward the flange of the other side wall means. The side surfaces of the decorative chip lie in parallel planes, the channel means in each side surface comprises a channel extending along the length of the side surface, and facing ends of the flanges extend into respective ones of the channels, whereby the decorative chip is held by the bracket.

In another embodiment, each side wall means of the bracket is a mirror image of the other and comprises a side wall extending generally vertically upward from the bottom wall to an upper end of the side wall, a horizontal wall extending generally horizontally outward from the upper end of the side wall and away from the bottom wall to an outer end of the horizontal wall, and a vertical wall extension extending generally vertically upward from the outer end of the horizontal wall to an upper end of the vertical wall extension, and each flange means comprises a flange extending generally horizontally from the upper end of the vertical wall extension of its side wall means and over the bottom wall toward the flange of the other side wall means. Facing ends of the flanges extends into respective ones of the channels, whereby the decorative chip is held by the bracket.

The foregoing and other objects, advantages and features of the invention will become apparent upon a consideration of the following detailed description, when taken in conjunction with the accompanying drawings.

DETAILED DESCRIPTION

Figure 3:
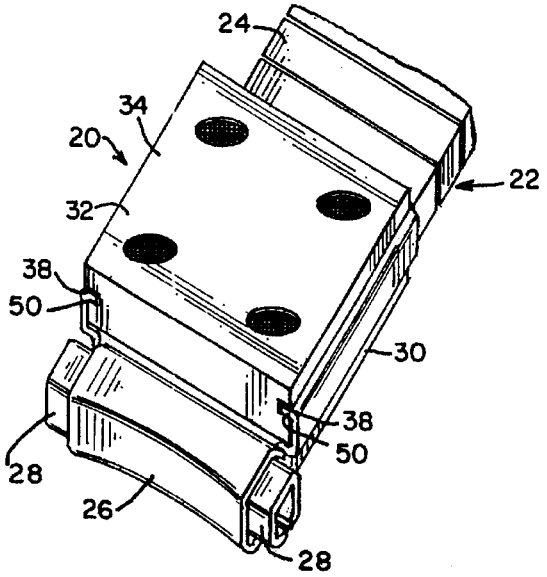
FIG. 3 shows the decorative item attached to the watchband.
Figure 2:
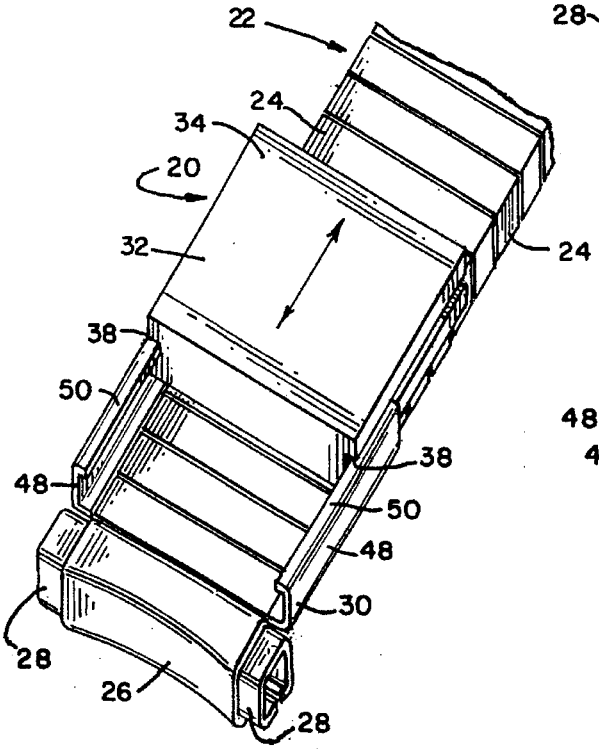
FIG. 2 shows the manner in which the decorative item is attached to the watchband.
Figure 1:
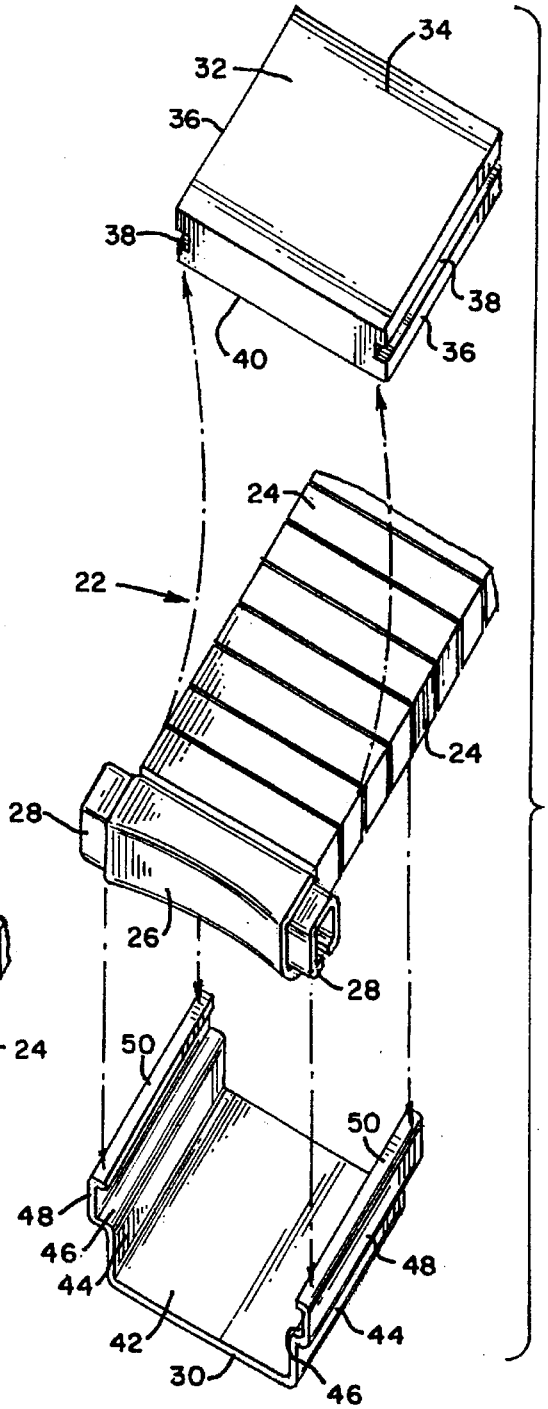
FIG. 1 is a perspective assembly view of a decorative item comprising a decorative chip and a bracket configured according to one embodiment of the invention, arranged to be attached to a watchband.

FIGS. 1–3 illustrate a decoration or decorative item, indicated generally at 20, that is adapted for economical and convenient attachment to and detachment from a watchband, indicated generally at 22. The watchband may be of the expansion type, or instead of a watchband, a bracelet of similar configuration could have the decorative item attached to it. The watchband is conventional and includes a plurality of links 24 that are interconnected in a known manner for elastic expansion and contraction of the watchband, and a fastening means at each opposite end of the watchband enables the watchband to be attached to a watch. The fastening means may include a tubular housing 26 in opposite side ends of which are slidably received a pair of pins 28 that are spring loaded for movement outwardly from the housing. As is well known and understood, the outer ends of the pins are received in recesses in a watch to attach the watchband to the watch.

The decoration 20 comprises a bracket 30 and a decorative chip 32. The decorative chip may take a desired form, for example the form of a face of a die representing the number "four," as seen in FIG. 3. The chip may be rectangular in configuration and has an upper decorative surface 34 on which the decorative form is provided. The width of the chip is between opposite parallel sides or surfaces 36 of the chip, and channels 38 in the surfaces extend along the length of the chip.

Watchbands customarily are available in either ⅝" or ¾" widths. The bracket 30 is specially configured to attach the decorative chip 32 to a ⅝" wide watchband. The bracket is made of a relatively flexible material such as brass or plastic, and has a rectangular bottom wall 42 from opposite sides of which side walls 44 extend generally vertically upward. The width of the bottom wall between the side walls is sufficient to accommodate the width of the ⅝" wide watchband therebetween and the length of the bracket between opposite open ends is about the same as the length of the sides 36 of the decorative chip.

The side walls 44 extend generally vertically upward from the bottom wall 42 of the bracket 30, by an mount about equal to the thickness of the watchband 22, to horizontal walls 46 that extend generally horizontally outward from upper ends of the side walls 44. Side wall extensions 48 extend generally vertically upward from outer ends of the horizontal walls 46 to generally horizontal flanges 50 that extend inwardly in facing relationship generally parallel to the bottom wall 42. The spacing between facing surfaces of the vertical wall extensions 48 is substantially equal to the width of the decorative chip 32 and the vertical spacing between facing surfaces of the horizontal walls 46 and the horizontal flanges 50 is substantially equal to the thickness of the decorative chip between its channels 38 and its lower surface 40.

FIG. 1 shows the orientation of the decorative chip 32 and the bracket 30 with respect to the watchband 22 for mounting the decoration 20 on the watchband. To mount the decorative item, as seen in FIG. 2 the bracket is nestled around the watchband, such that the watchband is on the bottom wall 42 and between the side walls 44 of the bracket. The decorative chip is then positioned at one end of the bracket and slid onto the bracket to cause the bracket flanges 50 to enter the channels 38 in the sides 36 of the chip, until the flanges fully enter the channels and securely capture the watchband between the chip and the bracket. The dimensional relationship advantageously is such that the watchband is gripped between the chip and bracket, so that the chip is fictionally retained in position with respect to the bracket and the bracket retains the chip on the watchband, thereby attaching the decoration to the watchband.

Figure 6:
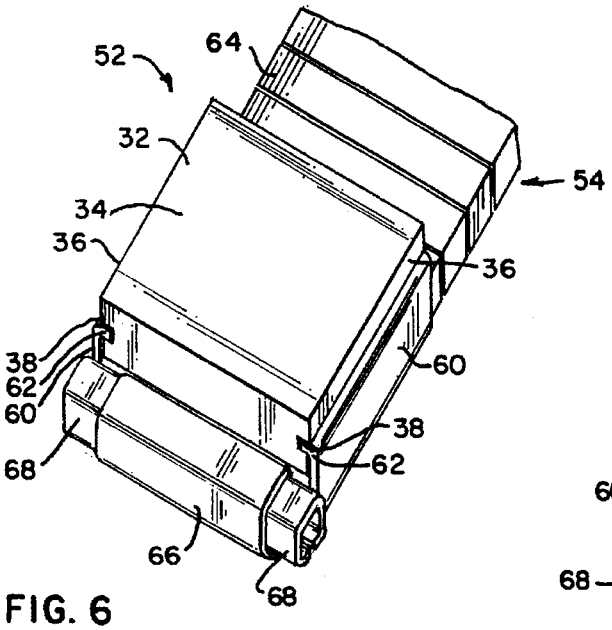
FIG. 6 shows the decorative item attached to the watchband.
Figure 5:
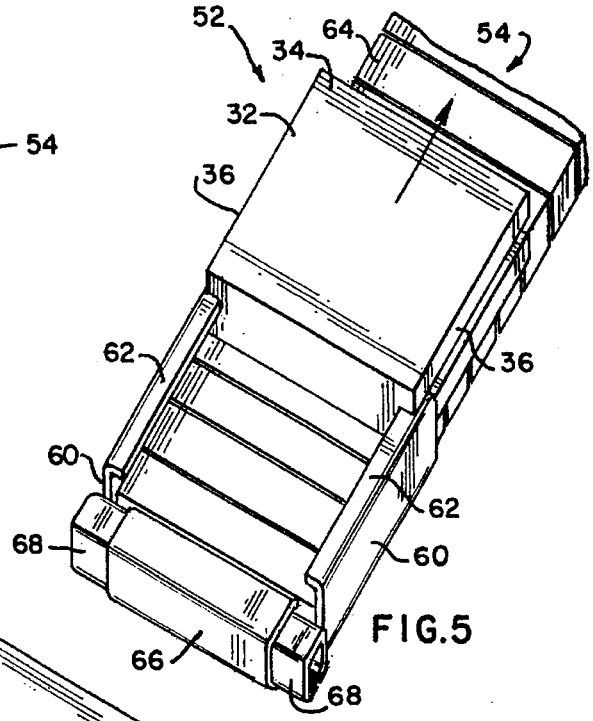
FIG. 5 illustrates the manner in which the decorative item is attached to the watchband.
Figure 4:
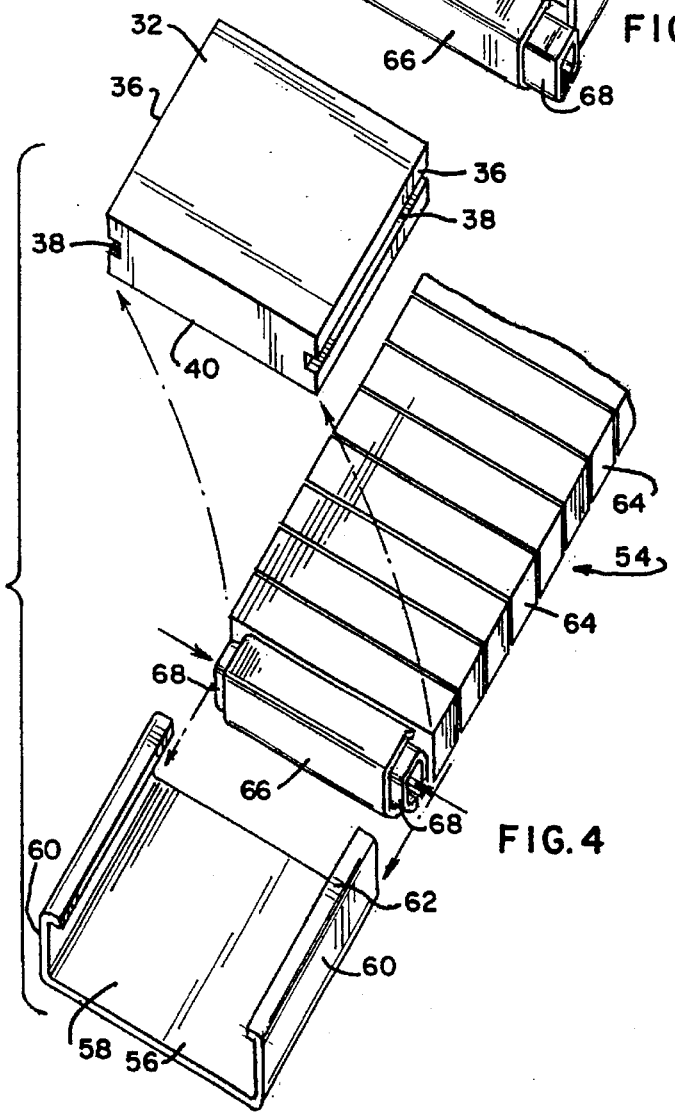
FIG. 4 is a perspective assembly view of a decorative item comprising a decorative chip and a bracket configured according to another embodiment of the invention, arranged to be attached to a watchband.

In the embodiment of the invention shown in FIGS. 4–6, a decoration or decorative item is indicated generally at 52 and is attached to a watchband, indicated generally at 54. The decoration includes a decorative chip that may be the same as the decorative chip 32 in the embodiment of FIGS. 1–3, so identical reference numerals have been used to denote like features of the chip.

This second embodiment differs from the first in the structure of a bracket 56 for attaching the decorative chip 32 to the watchband 54. In this case the watchband is ¾" wide and the bracket 56 is specially configured to attach the decorative chip to this wider watchband. The decorative chip is dimensioned the same as the decorative chip in FIGS. 1–3 and is about as wide as the watchband 54, and the bracket is structured to have a rectangular bottom wall 58 from opposite sides of which side walls 60 extend generally vertically upward to inwardly extending generally horizontal flanges 62 that extend over the bottom wall in facing relationship. The width of the bracket bottom wall between facing surfaces of the side walls 60 is substantially equal to the widths of each of the watchband 54 and chip 32, and the height of the side walls between facing surfaces of the bottom wall and the horizontal flanges is substantially equal to the combined thickness of the watchband and of the chip between its lower surface 40 and its channels 38. The lengths of the bracket bottom wall and of the sides 36 of the chip may be substantially equal.

Similar to the watchband 22, the watchband 54 comprises a plurality of links 64 that are interconnected in a known manner to accommodate elastic expansion and contraction of the watchband, and at each opposite end of the watchband is a fastening means for attaching the watchband to a watch. Each fastening means comprises a tubular housing 66 in opposite ends of which are slidably received pins 68 that are spring biased in the outward direction. Outer ends of the pins are adapted to be received in recesses in a watch to attach the watchband to the watch.

The spacing between facing ends of the horizontal flanges 62 of the bracket 56 is less than the width of the watchband 54, so the bracket cannot simply be moved into position around the watchband to attach the decorative item 20 to the watchband. Instead, it is necessary to push the pins 68 of one of the fastening means inwardly of their housing 66, so that the bracket can then be slid across the fastening means and around the watchband to the position shown in FIG. 5. The decorative chip 32 is then mounted on the bracket, thereby attaching the decorative item 52 to the watchband, in the same manner as described in connection with the embodiment of FIGS. 1–3.

While embodiments of the invention have been described in detail, various modifications and other embodiments thereof may be devised by one skilled in the art without departing from the spirit and scope of the invention, as defined in the appended claims.

What is claimed is:

1. A decorative item for watchbands and bracelets, said decorative item comprising a decorative chip having a decorative top surface, a bottom surface, side surfaces on opposite sides of said chip, and channel means in each said side surface extending along the entirety of the length of the side surface; and a bracket for mounting said decorative chip and for attaching said chip to a watchband or bracelet, said bracket having a bottom wall for extending in its entirety across a lower surface of the watchband or bracelet, side wall means extending upwardly from opposite sides of said bottom wall and for extending past opposite side of the watchband or bracelet to upper ends of said side wall means above an upper surface of the watchband or bracelet, and flange means at said upper ends of each said side wall means, said flange means being received in respective ones of said channel means in said side surfaces of said chip to mount said chip on said bracket with said decorative top surface of said chip facing upward and for gripping the watchband or bracelet between said bracket bottom wall and said chip bottom surface to frictionally retain and thereby attach said decorative item in position on the watchband or bracelet.

2. A decorative item as in claim 1, wherein said decorative chip side surfaces are planar.

3. A decorative item as in claim 1, wherein said decorative chip side surfaces lie in parallel planes.

4. A decorative item as in claim 1, wherein said flange means at said upper ends of said side wall means extend toward each other.

5. A decorative item as in claim 1, wherein said chip is rectangular, said chip side surfaces lie in parallel planes, and each said channel means extends along the length of its respective side surface.

6. A decorative item as in claim 1, wherein each said bracket side wall means is a mirror image of the other and comprises a side wall extending generally vertically upward from said bottom wall to an upper end of said side wall, and each said flange means comprises a flange extending generally horizontally from an upper end of a respective one of said side walls and over said bottom wall toward the other flange.

7. A decorative item as in claim 6, wherein said side surfaces of said decorative chip lie in parallel planes, said channel means in each said side surface comprises a channel extending along the length of said side surface, and facing ends of said flanges of said bracket extend into respective ones of said channels, whereby said decorative chip is mounted on said bracket.

8. A decorative item as in claim 7, wherein said decorative chip is generally rectangular and has a width between said side surfaces and a length perpendicular to said width, said bracket bottom wall is generally rectangular and has a width between said side walls and a length perpendicular to said width, and the lengths of said decorative chip and said bracket bottom wall are substantially equal.

9. A decorative item for watchbands and bracelets, said decorative item comprising a decorative chip having a decorative top surface, a bottom surface, side surfaces on opposite sides of said chip, and channel means in each said side surface; and a bracket for mounting said decorative chip and for attaching said chip to a watchband or bracelet, said bracket having a bottom wall for extending across a lower surface of the watchband or bracelet, side wall means extending upwardly from opposite sides of said bottom wall and for extending past opposite sides of the watchband or bracelet to upper ends of said side wall means above an upper surface of the watchband or bracelet, and flange means at said upper ends of each said side wall means, said flange means being received in respective ones of said channel means in said side surfaces of said chip to mount aid chip on said bracket with said decorative top surface of said chip facing upward and for capturing the watchband or bracelet between said bracket bottom wall, said bracket side wall means and said chip bottom surface to attach said decorative item to the watchband or bracelet, wherein each of said bracket side wall means is a mirror image of the other and comprises a side wall extending generally vertically upward from said bottom wall to an upper end of said side wall, a horizontal wall extending generally horizontally outward from said upper end of said side wall and away from said bottom wall to an outer end of said horizontal wall, and a vertical wall extension extending generally vertically upward from said outer end of said horizontal wall to an upper end of said vertical wall extension, and each said flange means comprises a flange extending generally horizontally from said upper end of a respective one of said vertical wall extensions and over said bottom wall toward the other flange.

10. A decorative item as in claim 9, wherein said side surfaces of said decorative chip lie in parallel planes, said channel means in each said side surface comprises a channel extending along the length of said side surface, and facing ends of said flanges of said bracket extend into respective ones of said channels, whereby said decorative chip is mounted on said bracket.

11. A decorative item as in claim 10, wherein said decorative chip is generally rectangular and has a width between said side surfaces and a length perpendicular to said width, said bracket bottom wall is generally rectangular and has a width between said side walls and a length perpendicular to said width, and the lengths of said decorative chip and said bracket bottom wall are substantially equal.

* * * * *